US007476051B1

(12) United States Patent
Kulp et al.

(10) Patent No.: US 7,476,051 B1
(45) **Date of Patent: *Jan. 13, 2009**

(54) LATERALLY STABLE VERTICAL PANEL SYSTEM

(75) Inventors: Brent M. Kulp, San Mateo, CA (US); David C. Gertz, San Clemente, CA (US)

(73) Assignee: Traffix Devices, Inc., San Clemente, CA (US)

( * ) Notice: Subject to any disclaimer, the term of this patent is extended or adjusted under 35 U.S.C. 154(b) by 198 days.

This patent is subject to a terminal disclaimer.

(21) Appl. No.: 11/011,359

(22) Filed: Dec. 13, 2004

Related U.S. Application Data

(63) Continuation of application No. 10/404,354, filed on Apr. 1, 2003, now Pat. No. 6,840,707, which is a continuation of application No. 09/847,876, filed on May 1, 2001, now Pat. No. 6,659,681, which is a continuation-in-part of application No. 09/247,217, filed on Feb. 10, 1999, now Pat. No. 6,402,422.

(51) Int. Cl.
*E01F 9/18* (2006.01)

(52) U.S. Cl. ..... 404/9; 404/6; 116/63 P

(58) Field of Classification Search ..... 404/9, 404/6, 10; 116/63 P, 63 R; 304/908.1; 40/606, 40/608, 610, 612; 248/910
See application file for complete search history.

(56) References Cited

U.S. PATENT DOCUMENTS

| | | | |
|---|---|---|---|
| 2,887,983 | A | 5/1959 | Budd |
| 3,380,428 | A | 4/1968 | Abrams |
| 3,502,007 | A | 3/1970 | Andersson |
| 3,507,245 | A | 4/1970 | Grabow |

(Continued)

FOREIGN PATENT DOCUMENTS

| | | |
|---|---|---|
| DE | 3109451 | 11/1982 |

(Continued)

OTHER PUBLICATIONS

Windbreakers Non-Metallic Channelizing Devices; Trafcon Industries Inc.; Patent Pending.

(Continued)

*Primary Examiner*—Richard E Chilcot, Jr.
*Assistant Examiner*—Chi Q Nguyen
(74) *Attorney, Agent, or Firm*—Stout, Uxa, Buyan & Mullins, LLP; Donald E. Stout

(57) ABSTRACT

A vertical panel system comprises a vertical panel having a panel with opposing first and second panel surfaces and a base edge. The system further comprises a base having a slot for engaging the base edge of the panel. An aperture is disposed in the panel in proximity to the base edge, which is of sufficient size to receive a foot of a user, for assisting in the engagement of the panel and the base. The base for the vertical panel system comprises a center zone fabricated of vulcanized rubber, and an outer zone fabricated of recycled rubber. The slot is disposed in the center zone. Thus, the combination solves a need to be environmentally responsible and cost effective by recycling rubber which would otherwise fill our landfills, yet provides increased durability by using virgin vulcanized rubber in the zone of the base which includes the engagement slot.

10 Claims, 5 Drawing Sheets

U.S. PATENT DOCUMENTS

| | | | | |
|---|---|---|---|---|
| 3,593,681 | A | 7/1971 | Semotitz | |
| 3,740,881 | A | 6/1973 | Finger | |
| RE29,566 | E | 3/1978 | Brudy | |
| 4,253,415 | A | 3/1981 | Ferch | |
| 4,354,772 | A | 10/1982 | Drexler | |
| 4,596,489 | A | 6/1986 | Mariol et al. | |
| 4,792,258 | A | 12/1988 | Goff | |
| 4,864,299 | A | 9/1989 | Kuhl | |
| 4,913,389 | A | 4/1990 | McCracken | |
| 5,003,912 | A | 4/1991 | Thurston | |
| 5,165,818 | A | 11/1992 | Newhart | |
| 5,168,827 | A | 12/1992 | Junker | |
| 5,267,523 | A | 12/1993 | Hugron | |
| 5,483,917 | A | 1/1996 | Walker | |
| 5,484,225 | A | 1/1996 | Warner | |
| 5,527,127 | A | 6/1996 | Junker | |
| 5,551,370 | A * | 9/1996 | Hwang | 116/63 T |
| 5,670,954 | A | 9/1997 | Junker | |
| 5,703,577 | A | 12/1997 | Carter | |
| 5,732,911 | A | 3/1998 | Kulp et al. | |
| 5,776,387 | A | 7/1998 | Prassas et al. | |
| 5,860,386 | A | 1/1999 | Schwab et al. | |
| 5,933,095 | A | 8/1999 | Junker | |
| 6,014,941 | A | 1/2000 | Bent et al. | |
| 6,099,443 | A | 8/2000 | Landfair | |
| 6,305,312 | B1 | 10/2001 | Bent et al. | |
| 6,402,422 | B1 * | 6/2002 | Gertz et al. | 404/9 |

FOREIGN PATENT DOCUMENTS

| | | | |
|---|---|---|---|
| DE | 3627146 | A1 | 5/1988 |
| DE | 3718440 | A1 | 12/1988 |
| EP | 257226 | | 3/1988 |
| EP | 570954 | | 11/1993 |
| FR | 2599064 | | 11/1987 |
| FR | 2703705 | | 10/1994 |
| GB | 2223786 | | 4/1990 |
| JP | 2003191282 | | 7/2003 |
| WO | WO90/01583 | | 2/1990 |

OTHER PUBLICATIONS

Big Foot Self Ballasting Vertical Channelizer; Protection Services Inc. a Division of Stabler Companies Inc.; Nov. 1995.

DDK Barricade; What Makes DDK The Best?; Service Signing L.C., Cedar Falls Iowa.

Impact Recovery Systems; Flexible Traffic Control Products; San Antonio Texas.

* cited by examiner

LATERALLY STABLE VERTICAL PANEL SYSTEM

This application is a continuation of application Ser. No. 10/404,354, now allowed, which is a continuation of application Ser. No. 09/847,876, now U.S. Pat. No. 6,659,681, which is a continuation-in-part of application Ser. No. 09/247,217, filed on Feb. 10, 1999, and now U.S. Pat. No. 6,402,422.

BACKGROUND OF THE INVENTION

1. Field of the Invention

This invention relates to traffic safety devices and, more specifically, to vertical panel display systems.

2. Description of the Related Art

Highway signs are generally used for promoting the safe passage of motor vehicles and/or pedestrians by advising of, for example, approaching unsafe driving conditions. These highway signs are generally provided with various highway legends, and are generally configured to flex in response to prevailing winds and wind gusts created by motor vehicles and the like.

It is known in the art to use a vertical panel system as a highway sign. In a typical vertical panel system, a vertical panel is on a collapsible support so that it folds down when impacted by a vehicle. This mitigates damage to the panel and the vehicle. A common example is an A-frame design consisting of two sides which are hinged together at the top. Each side has a panel attached to it. For support, the A-frame design is weighed down by sandbags. Upon impact, the A-frame folds flat. This design, while simple to build, is relatively unpredictable and requires at least two components, the A-frame and a sandbag, and maybe more than one sandbag.

An improvement on this idea is disclosed in U.S. Pat. No. 4,792,258 to Goff entitled "Collapsible Warning Barricade Apparatus" ("Goff"), which is incorporated herein in its entirety. Goff discloses a vertical panel pivotally attached to a base. The panel was maintained in a vertical position, with the use of a compression spring device that exerted a force on an automatic locking means at the pivot point. The automatic locking means has multiple elements that are coordinated to maintain the panel in an upright position until impact. Unfortunately, the design as disclosed in Goff is complicated to build and requires many parts.

It is also a problem with vertical panel systems that when they are impacted, the systems are dragged with the vehicle. As the base or support of the system is attached to the panel, both the panel and the base are damaged. Further, as the vehicle is dragging both the panel and the base, the vehicle incurs increased damage than if the panel was being dragged alone.

The prior art discloses a vertical panel system with a breakaway safety feature such that the panel separates from the base when impacted. This system is available under the trade name WindBreakers from Trafcon Industries Inc, 81 Texaco Road, Mechanicsburg, Pa. 17055. The WindBreakers' panel is attached to the rubber base via a breakaway pin that is inserted through the width of the panel. A disadvantage of the WindBreaker is that a replacement pin must be used to reattached the panel to the base as the original pin shears upon separation. Another disadvantage is that the WindBreaker panel flexes in the wind. An additional disadvantage is that the panel does not easily release to stack the bases and panels flat.

Another prior art system is disclosed in U.S. Pat. No. 5,670,954 to Junker. This system is similar to WindBreakers system discussed supra, in that a vertical panel 4 is secured to a base using a bolt and nut mechanical fastening combination. A disadvantage of this system is complexity. Additionally, the base securement is designed to be permanent, so there is no ability for the panel to break away from the base, short of the destruction of the system.

Still another prior art system is disclosed in U.S. Pat. No. 5,484,225 to Warner. This patent discloses a vertical panel system wherein a vertical panel is secured to a base without the use of mechanical fasteners, by means of a friction/compression fit. However, although this approach is an improvement over the systems discussed supra, it still has a number of problems. For example, to effect the panel/base attachment, the bottom edge of the panel is merely inserted into a slot in the base. There is no structure to prevent the vertical panel from rocking from side to side, and the engagement between the panel and base is subject to wear of the interior surface of the base slot over time, until at a particular point in time the friction/compression fit will be inadequate to properly support the panel. Additionally, there is no structure to assist a user in inserting the panel into the slot.

Therefore, it is desirable to have a vertical panel system which is collapsible upon impact, the panel is separable from the base during impact, is easily stacked, and made from relatively few parts. It is also desirable to have a panel that can be reattached to the base without replacing parts. It is also desirable to have the panel surface protected from scratches and mars while it is being hit or dragged. It is also desirable to have a panel that does not flex from the wind force.

SUMMARY OF THE INVENTION

The present invention provides an advantageous improved vertical panel system, which comprises a vertical panel having a panel with opposing first and second panel surfaces and a base edge. The system further comprises a base having a slot for engaging the base edge of the panel. Advantageously, an aperture is disposed in the panel in proximity to the base edge, which is of sufficient size to receive a foot of a user, for assisting in the engagement of the panel and the base.

In another aspect of the invention, there is provided a base for a vertical panel system, which comprises a center zone fabricated of vulcanized rubber, and an outer zone fabricated of recycled rubber. A slot is disposed in the center zone for receiving a base end of a vertical panel in engagement therewith. This arrangement solves a need to be environmentally responsible and cost effective by recycling rubber which would otherwise fill our landfills, yet provides great durability by using virgin vulcanized rubber in the zone of the base which includes the engagement slot.

In still another aspect of the invention, there is disclosed a method of assembling a vertical panel system comprised of a vertical panel having a base end and an aperture sufficiently large to accommodate a user's foot disposed adjacent to the base end. A base comprising a part of the system for ballasting the vertical panel has a slot for receiving the vertical panel base end. The inventive method comprises the steps of positioning the vertical panel over the base, so that the base end is in proximity to and just above the slot. Then, a user's foot is placed through the aperture, whereupon the user presses downwardly with his or her foot to apply downward force on the vertical panel, so that the base end of the vertical panel is inserted into and becomes engaged with the slot. This innovative method avoids the problem of using one's arms to press down from the top of the vertical panel, which can be a tiring and difficult job.

The invention, together with additional features and advantages thereof, may best be understood by reference to the following description taken in conjunction with the accompanying illustrative drawing.

DESCRIPTION OF THE PREFERRED EMBODIMENTS

Figure 1:
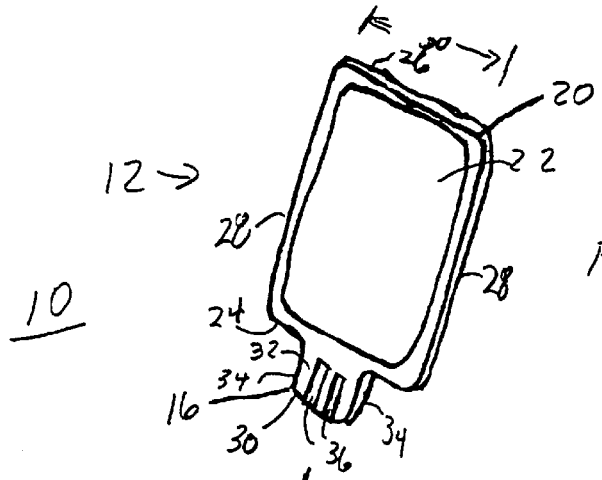
FIG. 1 shows an exploded perspective view of a vertical panel system with one panel according to an embodiment of the invention.

Referring now to the figures, wherein like reference numerals refer to like elements throughout the figures, and referring specifically to FIG. 1, a vertical panel system 10 according to an embodiment of the invention comprises a vertical panel 12 and a base 14. When a tab 16 extending from a lower end of the vertical panel 12 is inserted into a slot 46 in the base 14, the assembled vertical panel system 10 resembles an inverted T with the base 14 being the cross member. The vertical panel system 10 is designed to remain standing in wind and gusts from bypassing vehicles while being able to separate into the panel 12 and base 14 upon impact. Because the vertical panel system 10 is able to separate, the damage to the impacting vehicle and the system is mitigated.

The vertical panel 12 is comprised of a panel 20 with opposing panel first and second surfaces 22 (only one panel surface shown). The panel 20 has a base edge 24 proximate to the base 14 and from which the tab 16 extends. The panel 20 also has a top edge 26 that opposes the base edge 24. Two opposing side edges 28 of the vertical panel 12 extend between top edge 26 and the base edge 24.

In the illustrated embodiment of the invention, the edges 24, 26, and 28 are raised above the panel surfaces, so that the first and second panel surfaces 22 are recessed into the panel 20. Because the edges 24, 26, and 28 are raised, the edges get scraped during normal usage and wear and tear, rather than the panel surfaces 22 or anything on the panel surfaces. Examples of causes of scraping includes the system 10 being struck or the panel 20 skidding across the ground. The panel surfaces 22 may be reflective, either by having reflective material, such as sheeting, disposed thereon or the panel surfaces comprise reflective material. The panel surfaces 22 may have other indicia thereon. Whether it is reflective material or other indica on the panel surfaces, it is protected by the raised edges 24, 26, and 28.

In a preferred embodiment of the invention, the raised edges 24, 26, and 28 protrude in a direction normal to the panel surfaces 22. In other embodiments of the invention, the raised edges 24, 26, and 28 may extend above the panel surfaces in a direction other than normal to the panel surfaces. In some instances, it may be advantageous for only a portion of the edges 24, 26, and 28 to be raised, or the edges 24, 26, and 28 may be raised above only one of the panel surfaces. The edges 24, 26, and 28 may be integral to the panel 20 or may be a separate but attached component of the panel 20.

In the illustrated embodiment of the invention, the vertical panel 20 is rectangular. Other embodiments of the invention may have vertical panels of other shapes. In the preferred embodiment of the invention, the vertical panel 12 is comprised of double wall blow molded plastic. Other embodiments of the invention may have a vertical panel comprised of other materials.

The tab 16 extends from a base edge 24 of the panel 20 and terminates at a tab bottom edge 30. The tab 16 comprises two opposing side surfaces 32 (only one side surface is shown) that extend between two opposing side edges 34. Each of the tab side surfaces 32 have two tab grooves 36 extending from the tab bottom edge 30 and towards the panel base edge 24. In the preferred and shown embodiment of the invention, the tab bottom edge 30 is parallel to the panel base edge 24 and the tab grooves 36 extend perpendicularly to the bottom edge and the base edge. Other embodiments of the invention may have other relationships between edges 24 and 30 and the tab grooves 36. The tab bottom edge 30 extends a length 31 that is shorter than the width 50 of the panel 20.

In other embodiments of the invention, only one of the tab surfaces 32 may have tab grooves 36. In other embodiments of the invention, there may be more or fewer than two tab grooves 36 on a tab side surface 32. In the illustrated embodiment of the invention, the tab grooves 36 have a generally U-shaped profile (see FIG. 2). Other embodiments of the invention may have tab grooves with other suitable profiles. In the illustrated embodiment of the invention, the tab 16 and the panel 20 reside in generally the same plane. In other embodiments of the invention, the tab 16 may be oriented at a different angle to the panel 20, such as a plane extending through the tab side edges 34 defines a plane that is normal to the panel 20. In the illustrated embodiment of the invention, the panel 20 has one tab 16. Other embodiments of the invention may have more than one tab. In the illustrated embodiment of the invention, the tab 16 is of a rectangular cube shape. Other embodiments of the invention may have tabs of other shapes. In the illustrated embodiment of the invention, the tab 16 is integral to the panel 20. Other embodiments of the invention may have the tab 16 separably attached to the panel 20.

The base 14 has a top surface 40, a major axis 42 extending along the length of the base and a minor axis 44 extending along the width of the base. At the intersection of the axes 42 and 44 is a slot 46. The slot 46 extends from the top surface 40 and into the base 14. The slot 46 complements the tab 16 and the tab grooves 36. The fit of the slot 46 with the tab 16 may be loose, snug, or it may be an interference fit. An interference fit of the slot 46 and the tab 16 may be suitable for embodiments of the invention in which the base is made of an elastomeric material, such as rubber. The slot 46 may extend through the base 14 or terminate in the base.

To assemble the vertical panel system 10, the tab 16 is inserted into the slot 46. In the illustrated embodiment of the invention, the vertical panel 12 is oriented along the minor axis 44. Other embodiments of the invention may have the vertical panel oriented in other directions.

In the illustrated embodiment of the invention, the base 14 has a length 48 that is long enough to inhibit the vertical panel system 10 from tumbling in the direction of the major axis 42 when wind or gusts catches the vertical panel 20. The panel base edge 24 extends a width 50 that is substantially equal to a width 52 of the base 14.

Figure 2:
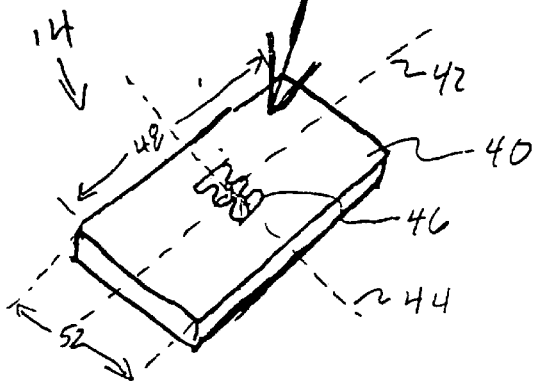
FIGS. 2 and 3 are perspective and plan views, respectively, showing details of assembly of the vertical panel system of FIG. 1.
Figure 2:
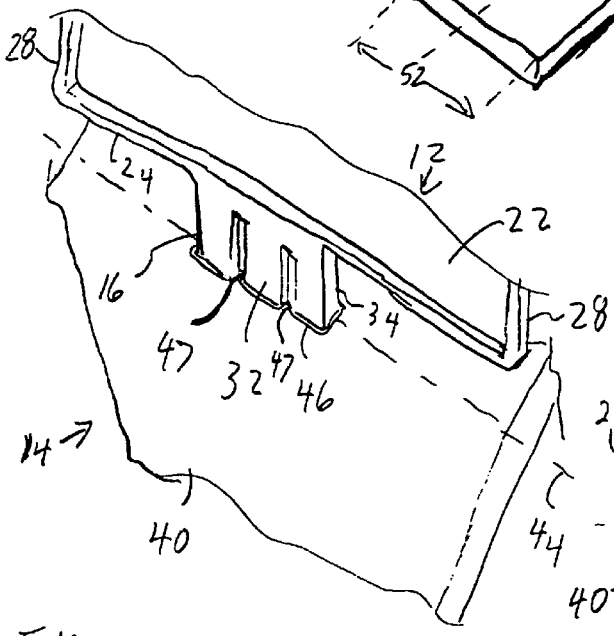
Figure 3:
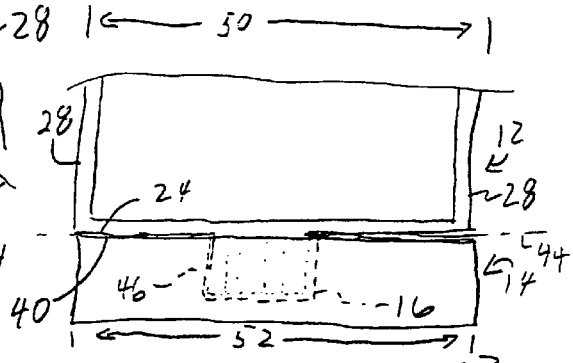

Referring now to FIGS. 2 and 3, the tab 16 is shown partially and fully inserted into the slot 46, respectively. The complementing slot 46 is shown with projections 47 extending into the grooves 36 in FIG. 3. It is clearly shown in FIG. 3 that the width 50 of the panel 20 is approximately the same of the width 52 of the base 14. Further, when the tab 16 is fully inserted into the slot 46, the base edge 24 of the panel 20 is in contact with the upper surface 40 of the base 14 across the width 52 of the upper surface. This contact provides a stable fitting of the panel vertical panel 12 and the base 14 that resists the tab 16 from coming out of the slot 46 through repeated lateral movements of the vertical panel 12 in the direction of the minor axis 44.

A significant advantage of the present invention over the prior art is that this "button" or "tongue and groove" engagement between the tab grooves 36 and the base projections 47 is a vast improvement over the mere friction/compression fit disclosed in the prior art, such as in the Warner '225 patent discussed supra. The advantages include increased durability, because wear and tear to the interface over time does not as severely affect the positive interface between the projections and grooves as it does a mere friction/compression fit, and improved stability, or, more specifically, the ability to resist rocking of the panel to the left or right side because of wind gusts due to passing traffic.

The base 14 is made of rubber in a preferred embodiment of the invention. The rubber base 14 provides ballast for the system 10 to inhibit tipping or moving the system while in use. Other embodiments of the invention may use any suitable ballasting type device as a base, such as a hollow plastic container filled with sand or another ballast or a frame that is secured in place with sand bags.

Figure 4:
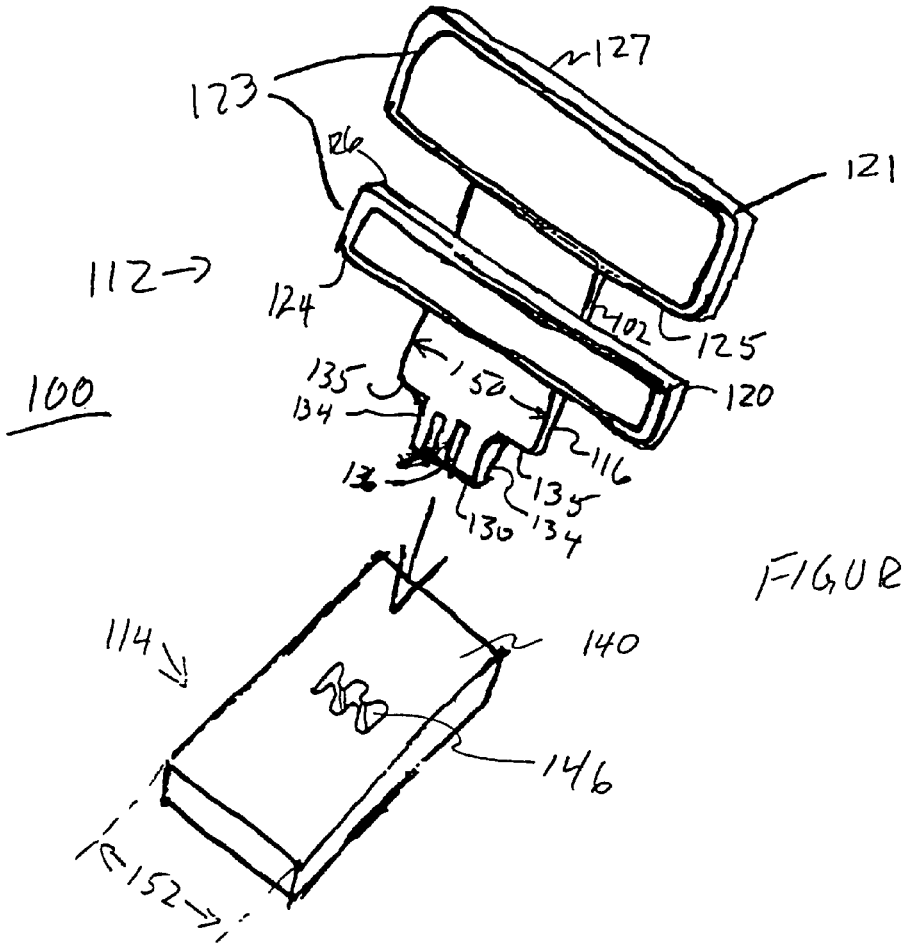
FIG. 4 shows an exploded perspective view of a dual vertical panel system according to an alternative embodiment of the invention.

Referring now to FIG. 4, a dual paneled vertical panel system 100 has a vertical panel 112 with a lower panel 120 and an upper panel 121 that is mounted in a base 114. In the illustrated embodiment, the panels 120 and 121 generally define a plane. Other embodiments of the invention may have the panels 120 and 121 at a different orientation relative to one another or to the ground.

The panels 120 and 121 preferably have raised edges 123. A base edge 124 of the lower panel 120 is located distal to a top edge 127 of the upper panel 121. A top edge 126 of the lower panel is located proximate to a base edge 125 of the upper panel 121. A support member 102 extends between the lower panel top edge 126 and the upper panel base edge 125. The support member 102 may be unitary with the two panels 120 and 121 or may be separably attached to the panels. Other embodiments of the invention may have different arrangements for the support member, including a plurality of support members or a support member that supports the two panels other than extending between the edges 125 and 126. In a preferred embodiment the support member 102 is integrally molded (such as by injection molding) with the panels 120, 121.

A tab 116 extends downwardly from the base edge 124 of the lower panel 120. The tab 116 has tab grooves 136, tab side edges 134, and a bottom edge 130 much like the tab grooves 36, tab side edges 34 and a bottom edge 30 of the vertical panel system 10. Additionally, tab 116 has shoulder portions 135 that laterally extend from the tab side edges 134. The shoulder portions 135 result in the tab 116 expanding to a width 150 (FIG. 5) as it approaches the lower panel. In a preferred embodiment of the invention, the width 150 is approximately the same as the width 152 of the base 114.

Figure 5:
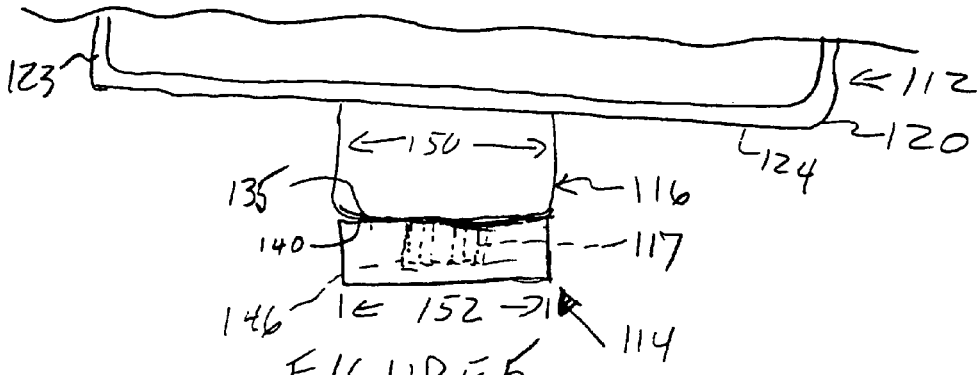
FIG. 5 is a plan view showing details of the engagement portion of the vertical panel system of FIG. 4.

Referring now to FIG. 5 as well, only a lower portion 117 of the tab 116 is inserted in a slot 146 of the base 114 when the system 100 is assembled. The tab lower portion 117 extends between the tab bottom edge 130 to the shoulders 135. FIG. 5 more clearly shows that the width 150 of the tab 116 is approximately the same as the width 152 of the base 114. This results in the shoulder 135 making contact with the base upper surface 140 across the width 152 of the base 114. The contact provides a very stable assembled system 100 as previously described in connection with the base edge 24 making contact with the base 14.

In an embodiment of the invention, panel surfaces are sized and positioned to conform to Type I or Type II barricade requirements. More specifically, the reflective sheeting requirements of the Type I or Type II barricades are mounted to appropriately sized and positioned panel surfaces in a vertical panel system that embodies the invention.

Figure 6:
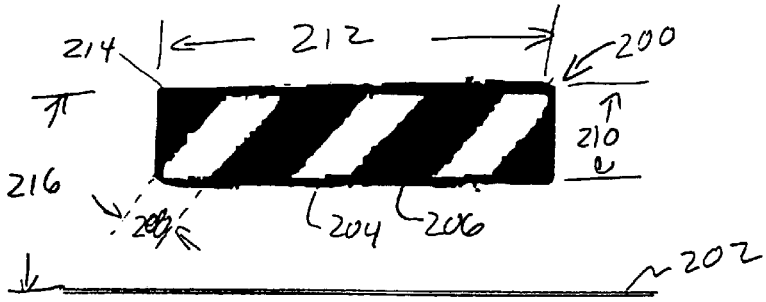
FIGS. 6 and 7 are plan views showing details and positioning of reflective portions of Type I and Type II barricades, respectively.

Referring now to FIG. 6, the size and positioning of a reflective portion 200 of a Type I barricade is shown relative to the ground 202. The reflective portion 200 has white stripes 204 that alternate with orange strips 206. The stripes 204 and 206 are oriented at a right-facing 45 degree angle and have a width 208 of six inches. Other reflective portions of Type I barricades may have the stripes 204 and 206 oriented in a left-facing manner. The portion 200 preferably has a height 210 of 8 to 12 inches and a length 212 of at least 2 feet. The top 214 of the portion 200 is at least 3 feet above the ground 202.

Figure 7:
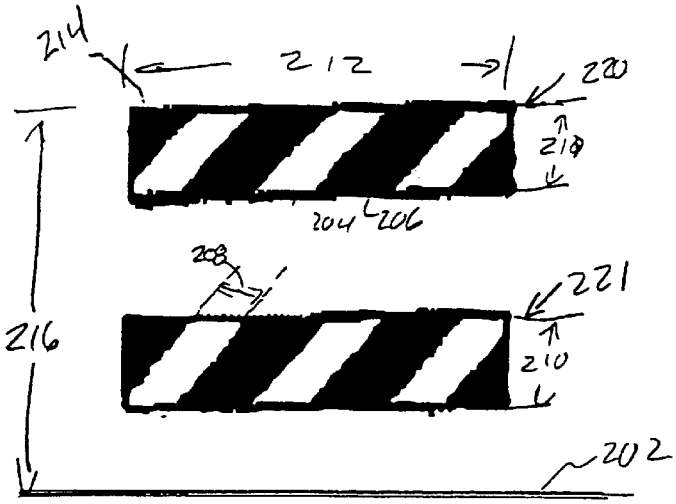

Referring now to FIG. 7, the size and positioning of an upper reflective portion 220 and a lower reflective portion 221 of a Type II barricade is shown relative to the ground 202. The stripes 204 and 206, the stripe width 208, the stripe orientation, the height 210 and the length 212 of each reflective portion 220 and 221 is the same as for the reflective portion 200. The portion 221 is positioned below the portion 220. The top edge 214 of the upper portion 220 is preferably greater than 3 feet from the ground 202.

In illustrated embodiments of the invention, the vertical panel has a contact surface that makes contact with the upper surface of the base. In the embodiment of the invention 10 shown in FIG. 1, the contact surface is the portion of the base edge 24 that extends beyond the tab 16. In the embodiment of the invention 100 shown in FIG. 4, the contact surfaces are the shoulders 135 of the tab 116. In preferred embodiments of the invention, the contact surface has an overall length that is approximately equal to the width of the base at the point of contact. The matching of the vertical panel contact surface length and the base width results in a laterally stable vertical panel system without having a vertical panel with excess material and the resulting higher manufacturing costs. Other, less preferred embodiments of the invention may have a vertical panel contact surface that does not extend across the width of the base. Additionally, other, less preferred embodiments of the invention may have portions of the contact surface extend beyond the width of the base.

Figure 9:
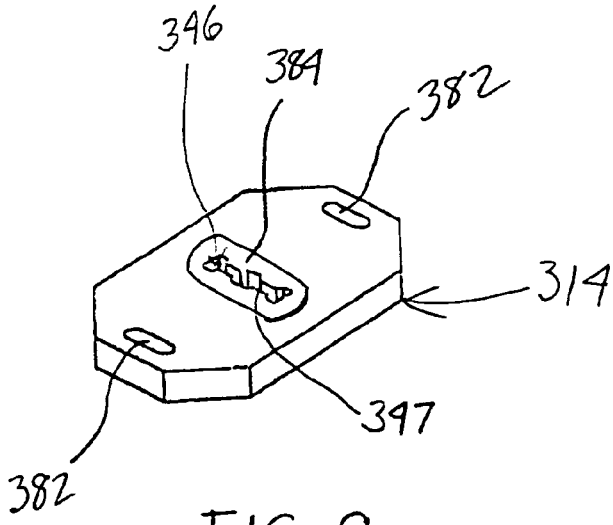
FIG. 9 is a perspective view of the base portion of the vertical panel system illustrated in FIG. 8.
Figure 10:
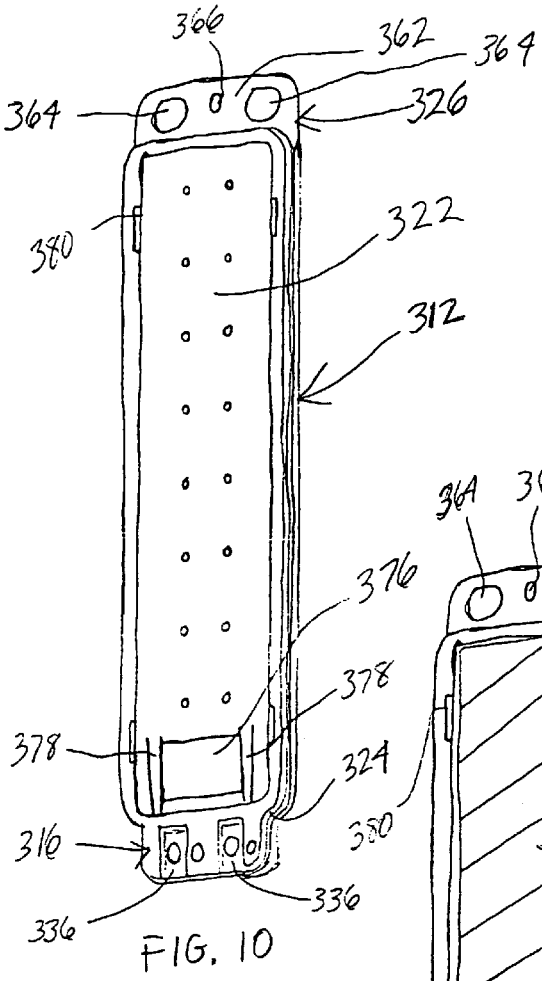
FIG. 10 is a perspective view of the vertical panel portion of the system of FIG. 8.
Figure 11:
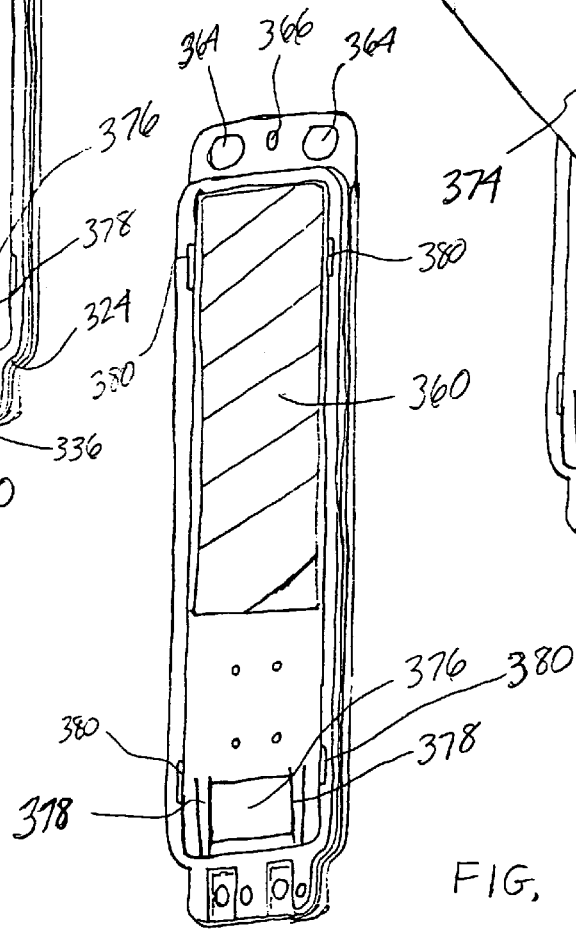
FIG. 11 is a view similar to FIG. 10 showing the application of reflective material to a front panel of the vertical panel portion.

Now with reference to FIGS. 9-11, a modified and preferably preferred embodiment of the invention is illustrated. In this embodiment, a vertical panel system 310 comprises a vertical panel 312 which is securable to a base 314 and includes a panel portion 322. As in prior embodiments, the vertical panel 312 is preferably blow molded of plastic, though any known fabrication techniques may be employed. As in the prior embodiments, as well, the panel portion 322 (preferably, opposing panel portions) is recessed relative to the raised edges of the vertical panel, to protect from incidental damage any reflective sheeting 360 (see FIG. 11) which may be disposed on the panel portion surface 322.

Figure 8:
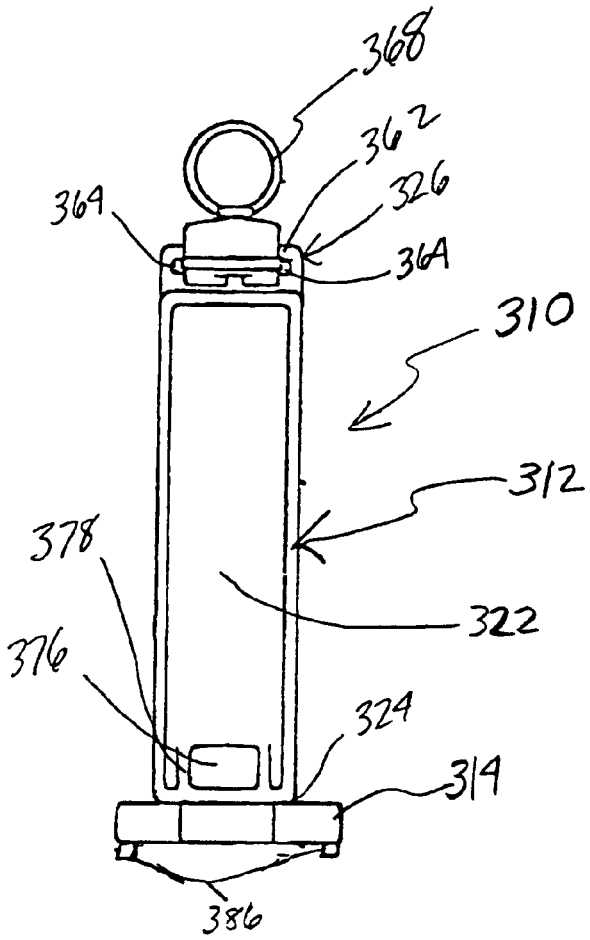
FIG. 8 is a plan view of another alternative embodiment of the present invention.
Figure 12:
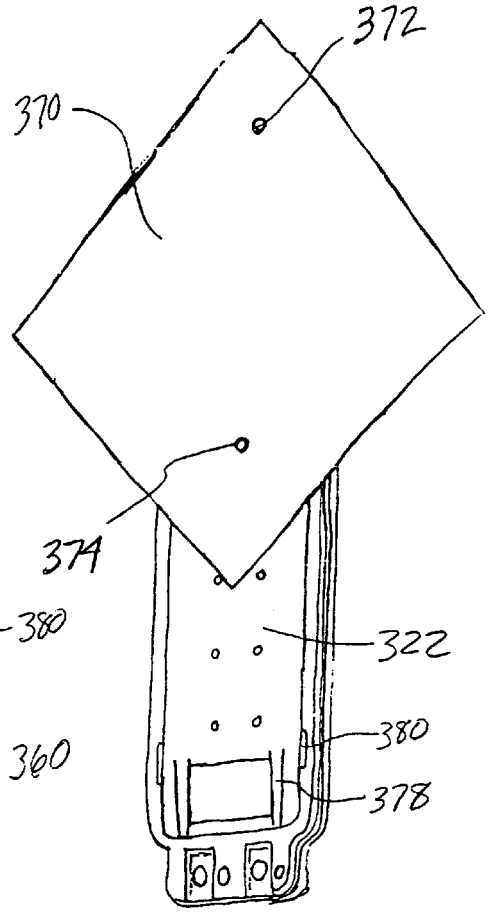
FIG. 12 is a view similar to FIG. 10 illustrating an alternative embodiment wherein a sign panel is attached to the vertical panel portion.

As shown in the FIGS. 9-11 embodiment, the top end 326 of the vertical panel 312 comprises a flange 362 having a pair of handle apertures 364, for easy carrying of the vertical panel 312, and a center mounting hole 366 for ready attachment of accessories. Such accessories may include a barricade light 368, as shown in FIG. 8, which is secured to the vertical panel 312 by means of mechanical fasteners attached to the mounting hole 366, and to a similar hole (not shown) in the light. The attachment mechanism is well known in the traffic safety product art for securing barricade lights to a variety of traffic safety products, typically barricades and traffic delineators. Other accessories might include a panel sign 370, as shown in FIG. 12, which may be attached to the vertical panel 312 by means of mechanical fasteners 372 and 374, wherein fastener 372 is secured to the mounting hole 366 and fastener 374 is secured to a second mounting hole extending through the vertical panel surface 322. The sign 370 may have any desired message displayed thereon, and may preferably be comprised of a corrugated semi-rigid material, or any other suitable rigid or semi-rigid material. In one preferred embodiment, the sign 370 is 36 inches square, although other dimensions may be suitable as well.

Another significant improvement in the FIG. 9 embodiment is the employment of a foot aperture 376, molded or cut into a bottom portion of the vertical panel surface 322, adjacent to the bottom edge 324 of the vertical panel 312. This foot aperture has been found by the inventors to be a significant advantage when inserting the tab portion 316 into the slot 346 in the base 314 to assembly the vertical panel system 10, in that it permits a user to merely place his or her foot conveniently into the aperture 376 and use downward force generated by the act of stepping down with the inserted foot to press the vertical panel 312 into the slot 346. Without using the aperture 376, which in preferred embodiments is approximately 3 inches high by 5 inches wide, the panel 312 must be pressed into the slot by pushing downwardly on the top edge of the panel 312 using the arms. As the insertion forces necessary to complete the assembly are quite high, this can be a tiring procedure.

In a particularly preferred embodiment, gussets 378 are molded in the vertical panel surface 322 adjacent to each side edge of the aperture 376. These gussets comprise raised portions or ridges, relative to the remaining vertical panel surface 322, which provide strength at the bend point.

Still another preferred feature is the employment of a plurality of stacking lugs 380 on each edge of the vertical panel 312, for assisting in stacking a plurality of vertical panels 312 together. Protruding stacking lugs on one side of each of the vertical panels engage complementary recesses on opposing sides of adjacent stacked vertical panels to thereby engage the vertical panels to one another, thus decreasing slippage of the stacked vertical panels relative to one another.

With respect to FIG. 9, in particular, the base 314 is an improved version of the bases shown in previous embodiments, in that carrying handles 382 have been molded or cut into opposing edges thereof. The base 314 is preferably molded of recycled rubber, such as crumb rubber, in order to reduce costs and to be environmentally responsible. However, Applicants have found that the use of crumb rubber in the vicinity of the slot 346 is not ideal, because it is much more prone to wear and tear (erosion) over time, shortening greatly the useful life of the base because the erosion will ultimately be too great to permit a proper friction/compression fit between the base and tab 316. Accordingly, Applicants have developed an innovative solution whereby a zone 384 of virgin vulcanized rubber is insert-molded into the crumb rubber base during the fabrication process. The slot 346 is then formed in the vulcanized rubber zone, providing reinforcement from wear and tear due to repeated panel separation. In presently preferred embodiments, the base 314 is fabricated in two weights—28 pounds and 43 pounds.

Still another innovative feature is the employment of four raised anti-rotational foot pads 386 (FIG. 8) on the lower surface of the base 314, to minimize movement from wind, or turbulence from passing vehicles. This is particularly important in the case of vertical panels, where it is important to maintain a zero degree orientation relative to passing traffic. Preferably, these feet 386 are molded into the extreme corners of the base, and may comprise in one preferred embodiment a size of three inches in diameter and ¼ inch in height.

The vertical panels illustrated in the drawings are merely representative of the various shapes, sizes, and configurations which fall within the scope of the claimed invention. For example, vertical panel systems may be offered in various sizes, such as 36 inch×8 inch, 24 inch×12 inch, 24 inch×8 inch, or 29½ inch×12 inch, and may be utilized in combination with different sized bases (such as the 28 and 43 pound bases which are presently preferred). Additionally, the reflective sheeting on the panel face may cover some or all of the available surface, depending upon application. As an alternative to the illustrated striped pattern, a vertical panel may accommodate a display sign, with a message for passing motorists.

Although presently preferred embodiments of the present invention have been described in detail hereinabove, it should be clearly understood that many variations and/or modifications of the basic inventive concepts herein taught, which may appear to those skilled in the pertinent art, will still fall within the spirit and scope of the present invention, as defined in the appended claims.

The invention claimed is:

1. A vertical panel system comprising:

a vertical panel comprising a panel with opposing first and second flat panel surfaces and a base edge, a tab extending downwardly from said panel base edge and terminating at a tab bottom edge;

a base having a slot for engaging said tab of said panel, for releasably attaching said panel and said base;

an aperture disposed through said first and second panel surfaces in proximity to said base edge, above said tab and said base edge, said aperture being of sufficient size to receive a foot of a user, for assisting in the engagement of said panel and said base, said aperture not extending through either of said opposing side edges; and a gusset disposed adjacent to said aperture on said panel.

2. The vertical panel system as recited in claim 1, and further comprising a plurality of stacking lugs molded into said vertical panel for assisting in stacking a plurality of said vertical panels atop one another.

3. The vertical panel system as recited in claim 1, wherein said base comprises recycled rubber material.

4. The vertical panel system as recited in claim 3, wherein said base further comprises a zone disposed in a center portion of said base, which is comprised of vulcanized rubber, said slot being disposed in said zone.

5. The vertical panel system as recited in claim 1, wherein said aperture is more than three inches wide.

6. The vertical panel system as recited in claim 5, wherein said aperture is approximately five inches wide.

7. The vertical panel system as recited in claim 1, wherein said aperture is approximately three inches high.

8. The vertical panel system as recited in claim 1, wherein said first and second panel surfaces are both substantially flat.

9. A vertical panel system comprising:

a vertical panel comprising a panel with opposing first and second flat panel surfaces and a base edge, a tab extending from said panel base edge and terminating at a tab bottom edge;

a base comprising recycled rubber material and having a slot for engaging said tab of said panel, for releasably attaching said panel and said base;

an aperture disposed through said first and second panel surfaces in proximity to said base edge, above said tab, said aperture being of sufficient size to receive a foot of a user, for assisting in the engagement of said panel and said base, said aperture not extending through either of said opposing side edges;

a gusset disposed adjacent to said aperture on said panel.

10. The vertical panel system as recited in claim 9, wherein said base further comprises a zone disposed in a center portion of said base, which is comprised of vulcanized rubber, said slot being disposed in said zone.

* * * * *